US011742618B2

(12) United States Patent
Baena

(10) Patent No.: US 11,742,618 B2
(45) Date of Patent: Aug. 29, 2023

(54) ELECTRICAL CONNECTOR WITH ELECTROMECHANICAL LOCKING

(71) Applicant: Airbus Operations SAS, Toulouse (FR)

(72) Inventor: Pierre Baena, Toulouse (FR)

(73) Assignee: Airbus Operations SAS, Toulouse (FR)

( * ) Notice: Subject to any disclaimer, the term of this patent is extended or adjusted under 35 U.S.C. 154(b) by 347 days.

(21) Appl. No.: 17/181,578

(22) Filed: Feb. 22, 2021

(65) Prior Publication Data

US 2021/0265779 A1 Aug. 26, 2021

(30) Foreign Application Priority Data

Feb. 24, 2020 (FR) ..... 2001791

(51) Int. Cl.
*H01R 13/639* (2006.01)
*H01R 13/20* (2006.01)
(Continued)

(52) U.S. Cl.
CPC ..... *H01R 13/639* (2013.01); *H01R 13/20* (2013.01); *H01R 13/6205* (2013.01);
(Continued)

(58) Field of Classification Search
CPC .... H01R 2201/00; H01R 24/76; H01R 13/66; H01R 13/6205; H01R 13/20; H01R 13/6278; H01R 4/5058
See application file for complete search history.

(56) References Cited

U.S. PATENT DOCUMENTS 4,838,804 A * 6/1989 Banjo ..... H01R 12/722 439/325
7,125,273 B2 * 10/2006 Irwin ..... H01R 13/6276 439/348

(Continued)

FOREIGN PATENT DOCUMENTS

| | | | |
|---|---|---|---|
| CN | 109004452 | A | 12/2018 |
| JP | 2005235679 | A | 9/2005 |
| WO | 2011071170 | A1 | 6/2011 |

OTHER PUBLICATIONS

French Search Report; priority document.

*Primary Examiner* — Briggitte R. Hammond
(74) *Attorney, Agent, or Firm* — Greer, Burns & Crain, Ltd.

(57) ABSTRACT

An electrical connector provided with at least one male or female plug configured to be connected to a socket. The electrical connector includes at least one locking system provided with a polarized ferromagnetic locking element and with a return element, which are configured to have a first shape corresponding to a locking configuration of the electrical connector that is at least partially complementary to a shape of the connection plug or of the socket when an intensity of a current flowing through the connection plug is higher than or equal to a predetermined value, and a second shape corresponding to a non-locking configuration of the electrical connector when the intensity of the current flowing through the connection plug is lower than the predetermined value, so as to electromechanically lock the connection plug in the socket of the connector.

10 Claims, 8 Drawing Sheets

(51) Int. Cl.

| | |
|---|---|
| ***H01R 13/62*** | (2006.01) |
| ***H01R 13/66*** | (2006.01) |
| ***H01R 24/76*** | (2011.01) |
| ***H01R 13/627*** | (2006.01) |

(52) U.S. Cl.
CPC ..... *H01R 13/66* (2013.01); *H01R 24/76* (2013.01); *H01R 13/6278* (2013.01); *H01R 2201/00* (2013.01)

(56) References Cited

U.S. PATENT DOCUMENTS

| | | | | |
|---|---|---|---|---|
| 8,287,298 | B2 * | 10/2012 | Hsu | H01R 13/6395 439/352 |
| 8,956,173 | B2 * | 2/2015 | Pomerantz | G06F 21/82 439/660 |
| 10,116,089 | B1 * | 10/2018 | Hu | H01R 13/6683 |

* cited by examiner

ELECTRICAL CONNECTOR WITH ELECTROMECHANICAL LOCKING

CROSS-REFERENCES TO RELATED APPLICATIONS

This application claims the benefit of the French patent application No. 2001791 filed on Feb. 24, 2020, the entire disclosures of which are incorporated herein by way of reference.

FIELD OF THE INVENTION

The present invention relates to the field of connectors. More particularly, the present invention relates to an electrical connector with electromechanical locking for the interconnection of items of technical equipment and, in particular, EWIS (electrical wiring interconnection system) electrical systems, in particular on board an aircraft, and to an aircraft comprising at least one such electrical connector.

BACKGROUND OF THE INVENTION

Electrical, electronic and computer systems, also commonly called onboard systems, are widely employed in transport, including air transport. Such systems require connection to one or more power sources and often require interconnection between them.

The connectors are commonly identified as one of the weak points in an interconnect harness between items of electrical equipment. Electrical equipment is increasingly important on board aircraft. This phenomenon is accompanied with an increase in currents and voltages applied to equipment, both in terms of continuous operation and in terms of intermittent operation.

The systems for interconnecting the items of equipment have to be adapted accordingly in order to provide a level of reliability that is compatible with the safety of the equipment and people.

SUMMARY OF THE INVENTION

The present invention aims, in particular, to improve and secure the electrical connections between various items of equipment, in particular those on board an aircraft.

To that end, an object of the invention is to provide an electrical connector comprising:

- a socket made in an electrically conductive material,
- a connector body made in an electrically insulating material and in which the socket is fixed, where the connector body has a cavity allowing access to the socket,
- a connection plug made in an electrically conductive material and configured to be inserted into the cavity of the body of the connector in a direction of insertion and to come into contact with the socket, and,
- a locking system comprising a locking element and a return element, and in which the locking element comprises a polarized ferromagnetic material and is movably mounted, via the return element, on one from among the connector body and the connection plug, so as to be movable between a locking position in which the locking element is housed in a recess formed in the surface of the other from among the connection plug and the connector body, and a non-locking position in which the locking element is not housed in the recess, and where the return element holds the locking element in the non-locking position.

Ingeniously, when an electric current whose intensity is higher than a predetermined threshold flows though the connection plug and the socket of the electrical connector, the magnetic field induced causes the magnetized locking element to move between the non-locking position and the locking position of the electrical connector and locks the connection so as to prevent the connection plug from being removed from the socket.

The electrical connector, according to the invention, may also comprise the following features, considered individually or in combination:

- the locking element is a stud whose shape is at least partially complementary to the shape of the recess, attached to the return element, the return element is a spring attached substantially perpendicularly to the direction of insertion to one from among the connector body and the connection plug, and the stud is mounted so as to be movable in a direction transverse to the direction of insertion.
- The locking system is mounted on the connector body.
- The locking system is mounted on the connection plug.
- The shape of the locking element is spherical or has a circular cross section and the shape of the recess is complementary to a spherical shape or to a circular cross section.
- The locking element is a magnetized strip and the return element is an elastic strip, and the two strips are attached to one another by one of their respective ends.
- The locking element is a central portion of a one-piece locking system comprising a flexible, preferably elastic, peripheral portion forming a return element.
- The electrical connector comprises a plurality of locking systems distributed around the direction of insertion, preferably uniformly distributed around the direction of insertion.

Another subject of the invention is an electrical or electronic system configured to implement one or more avionics functions comprising at least one electrical connector such as described above.

Lastly, another subject of the invention is an aircraft comprising at least one electrical or electronic system such as described above.

BRIEF DESCRIPTION OF THE DRAWINGS

The features of the invention mentioned above, along with others, will become more clearly apparent on reading the following description of at least one exemplary embodiment, the description being given with reference to the appended drawings, in which.

DETAILED DESCRIPTION OF THE PREFERRED EMBODIMENTS

Figure 1:
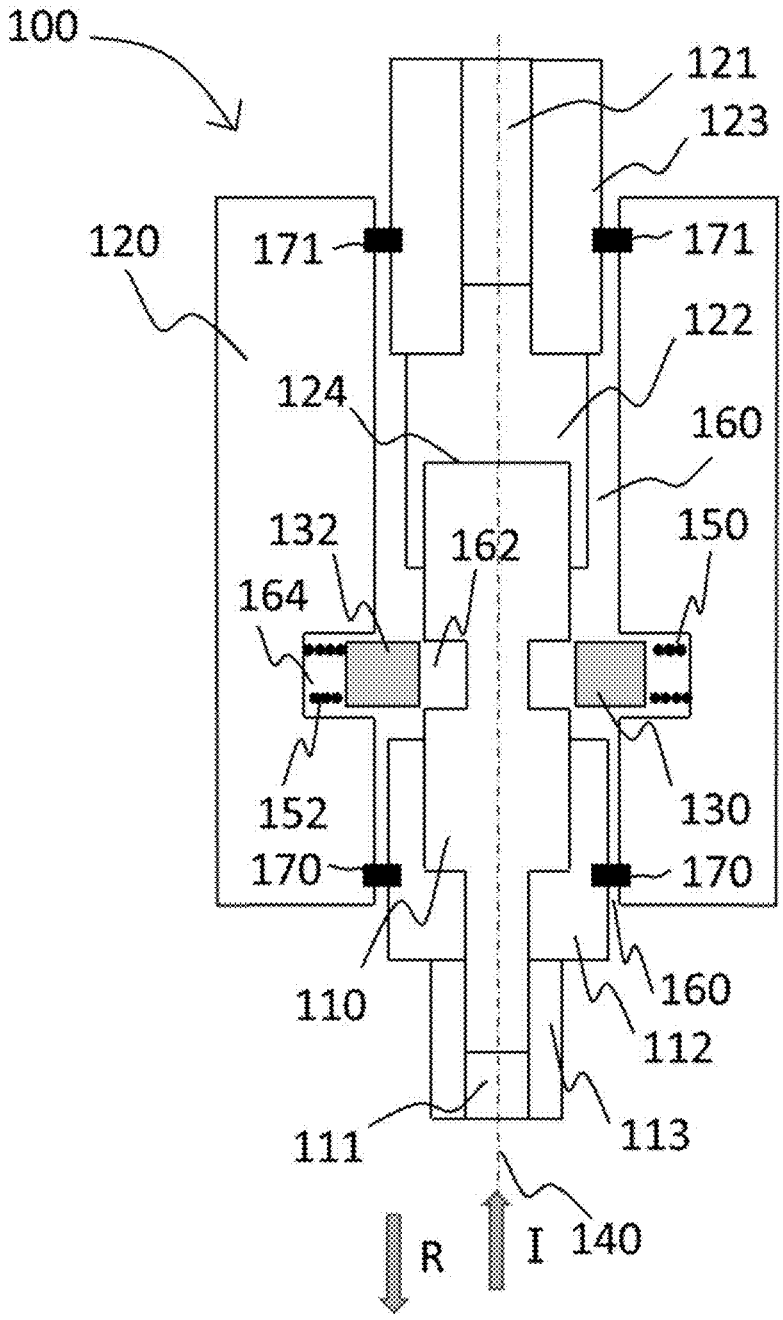
FIG. 1 schematically illustrates an electrical connector according to a first embodiment, in the unlocking configuration.

FIG. 1 is a cross section schematically showing an electrical connector 100 according to one embodiment.

The electrical connector 100 comprises a socket 122. The socket 122 is made of an electrically conductive material and is fixed in a first body 120, also called the "connector body," of the connector 100. According to some variant embodiments, the socket 122 may be securely fixed to the connector body 120 or else fixed in a removable manner.

The connector body 120 is made in an electrically insulating material. The socket 122 is configured to be connected to a first cable 121, for example by soldering or crimping. The first cable 121 is surrounded with a sheath 123 made of electrically insulating material. In the embodiment shown here, the connection between the socket 122 and the cable 121 is made on the side opposite its end that is configured to receive the connection plug 110, i.e., the top side in FIG. 1.

The electrical connector 100 also comprises a connection plug 110 which is made in an electrically conductive material and which is fixed here in a second body 112. The body 112 of the connection plug 110 is made of electrically insulating material. According to one variant of the embodiment, the connection plug 110 is without a body and the body 112 does not exist.

The connection plug 110 is configured to be connected to a second cable 111, for example by soldering or crimping. The second cable 111 is surrounded with a sheath 113 made of electrically insulating material. In the embodiment presented here, the connection to the cable 111 is made on the side opposite its end, i.e., the bottom side in FIG. 1.

According to one embodiment, the material of the connector body 120 of the connector 100 has similar mechanical and dielectric characteristics to the material of the second body 112. For example, the materials of the connector body 120 and of the second body 112 are identical. According to one variant, the material of the connector body 120 is different from the material of the second body 112.

The connector body 120 has a cavity 160 allowing the socket 122 to be fixed therein and to further provide access to the socket 122 for the connection plug 110. The cavity 160 defines a hollow volume around a direction of insertion 140. The cavity 160 is arranged to accommodate the connection plug 110, potentially provided with the body 112 (optional), and to allow the connection plug 110 to be guided easily towards the socket 122. The cavity 160 allows the socket 122 to be brought into contact with the connection plug 110. The socket 122 is held in the connector body 120 by virtue of a mechanical retaining system 171. According to an analogous securing principle, the connection plug 110 is held in the connector body 120 by virtue of a mechanical retaining system 170.

When the connection plug 110 comprises a body 112, the mechanical retaining system 170 may be arranged between the body 112 and the connector body 120 (as shown in the figures) or else between the connection plug 110 and the connector body 120. When the connection plug 110 does not comprise the body 112 (optional), the mechanical retaining system is arranged between the connection plug 110 and the connector body 120.

According to one embodiment, the mechanical retaining systems 170 and 171 each comprise an elastic washer held tightly between two recesses. According to some variants, the mechanical systems 170 and 171 each comprise a collar and a clip or complementary (concave and convex) shapes that are configured to mechanically lock the socket 122 and the connection plug 110 by translation, with respect to the connector body 120, in the direction of insertion 140. The mechanical retaining systems 170 and 171 are not described in greater detail here because this is not necessary for the understanding and implementation of the invention.

The connection plug 110 is introduced into the connector body 120 parallel to the direction of insertion 140. The direction of insertion of the connection plug 110 into the connector body 120 is represented by an arrow I in FIG. 1 and the direction of withdrawal of the connection plug 110 from the connector body 120 is represented by an arrow R in FIG. 1.

Thus, physical contact between the connection plug 110 and the socket 122 establishes electrical continuity between the first cable 121 and the second cable 111.

In the embodiment of the invention shown in the figures, the socket 122 is of female type and has a void 124 and the connection plug 110 is of male type. Thus, the connection plug 110 is first inserted into the cavity 160 of the connector body 120, then into the void 124 of the socket 122, the shape of which is substantially complementary to the end of the connection plug 110.

Of course, according to one variant, the connection plug 110 may be arranged so as to be of female type and the socket 122 may be arranged so as to be of male type.

According to the embodiment shown, the connection plug 110 has a first circular straight recess 162 formed in its surface.

The connector body 120 has a second circular straight recess 164 formed in the surface of the cavity 160.

The first recess 162 faces the second recess 164 when the connection plug 110 is inserted into the connector body 120 and comes into contact with the socket 122, in the direction of insertion represented by the arrow I.

The terms "circular straight recess" should be interpreted here as meaning a recess with a straight bottom extending over a surface of a part with a circular cross section, such as the inner surface of the cavity 160 or the outer surface of the connection plug 110.

According to the embodiment shown in FIG. 1, at least one locking system is housed in the second recess 164 of the connector body 120. The locking system comprises a locking element 130 and a return element 150.

The locking element 130 comprises a polarized ferromagnetic material and is movably mounted on the connector body 120 so as to be movable between a locking position in which the locking element is housed in the first recess 162 formed in the connection plug 110 and a non-locking position in which the locking element 130 is out of the first recess 162, and where the return element 150 holds the locking element 130 in the non-locking position.

Figure 2:
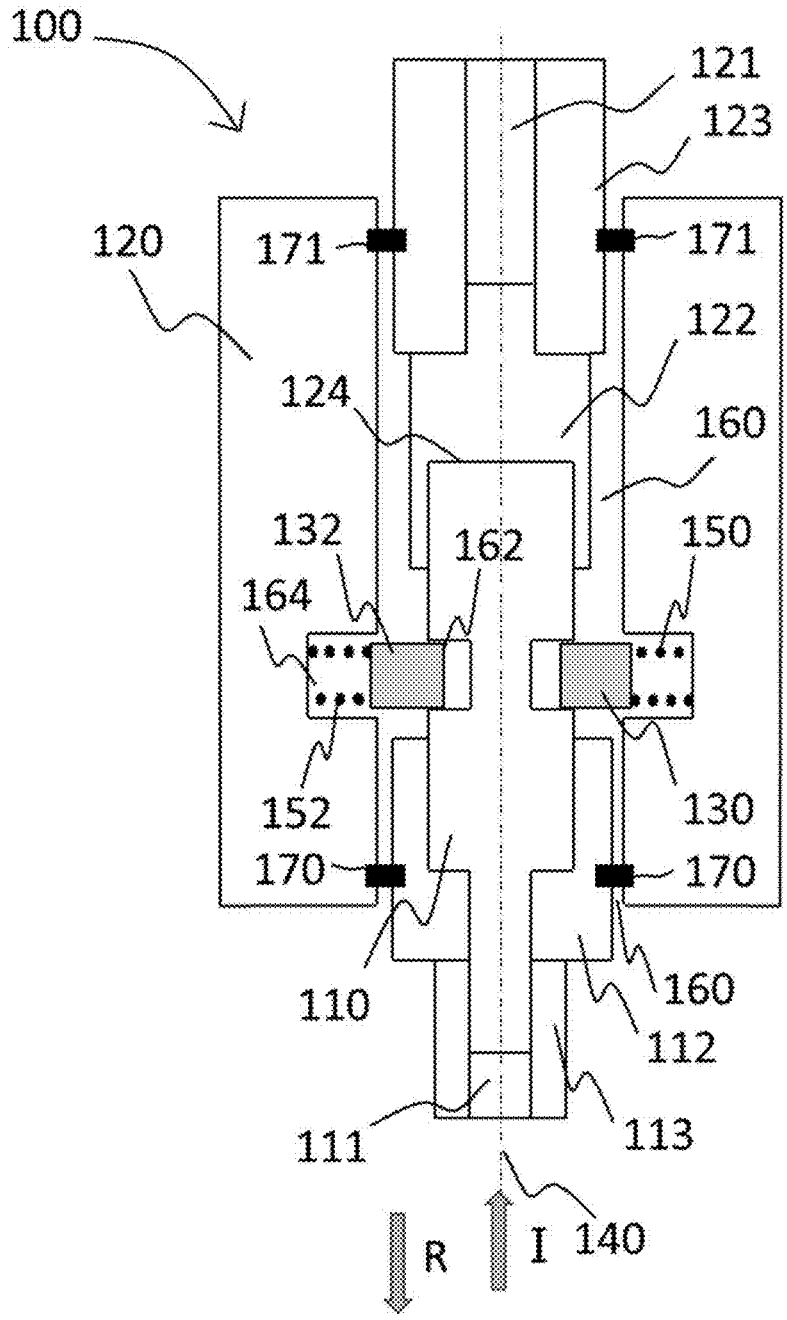
FIG. 2 schematically illustrates the electrical connector already shown in FIG. 1, in the locking configuration.

The non-locking position is shown in FIG. 1 and the locking position is shown in FIG. 2.

In the embodiment shown in FIG. 1, the locking element 130 is a stud mounted movably in translation in the second recess 164 and the return element 150 is a coil spring fixed in the second recess 164 between the bottom of the second recess 164 and the stud. The shape of the stud is at least partially complementary to the shape of the first recess 162. The spring is here fixed substantially perpendicularly to the direction of insertion 140 and the stud is mounted so as to move in a direction transverse to the direction of insertion 140.

A return element is fixed into the second recess 164 by, for example, soldering, bonding, or by overmolding during the manufacture of the electrical connector 100.

The magnetic polarization of the locking element 130 is such that, when a current whose intensity is higher than a predetermined threshold flows through the electrical connector 100, the locking element 130 switches from the non-locking position to the locking position under the effect of a magnetic field induced by the current flowing through the electrical connector 100. Conversely, when the intensity of the current in the electrical connector 100 falls back below the predetermined threshold, the return element 150 returns the locking element 130 to the non-locking position. The return force effected by the return element 150 of the locking system is defined with respect to the predetermined current-intensity threshold.

The overall locking system, i.e., the assembly of the locking element 130 and of the return element 150, is configured so as not to hinder the insertion of the connection plug 110 into the socket 122 when no electrical current is flowing through the connector 100.

The locking thus performed is of the electromechanical type, of electromagnetic origin. This electromechanical locking is effected in addition to the mechanical locking already performed by the mechanical retaining systems 170 and 171 which secure, respectively, the connection plug 110 and the socket 122 in the connector body 120.

Advantageously, the locking element 130 may be covered, completely or partially, with an electrically insulating material so as not to interact with the electrical connection elements which are the connection plug 110 and the socket 122.

Locking is effected, here, when a surface of the locking element 130 substantially perpendicular to the direction of insertion 140 bears against a surface of the first recess 162, which surface is also substantially perpendicular to the direction of insertion 140, so as to act against withdrawal of the connection plug 110 from the socket 122.

Advantageously, the shape of the locking element 130 is at least partially complementary to a shape of the first recess 162 so as to prevent substantial functional play and to ensure good physical contact between the end of the connection plug 110 and the socket 122, so that the physical contact per se is optimized and made secure.

FIG. 1 illustrates an electrical connector, the cross section of which shows two identical locking elements. The first locking system comprises the locking element 130 and the return element 150. The second locking system comprises a locking element 132 and a return element 152. According to one variant, the electrical connector 100 comprises a number of locking systems greater than two and these systems are arranged regularly around the connection plug 110, and therefore around the direction of insertion 140, in the second recess 164.

Advantageously, when a plurality of locking elements are present, they may all be covered with an electrically insulating material so as not to interact with the electrical connection elements. According to some variants and depending on the embodiment of the connection plug 110 and of the socket 122, only some locking elements may be covered, completely or partially, with an electrically insulating material.

Such an electrical connector therefore makes it difficult, or even impossible, for a person handling it to disconnect the connection plug, on load, by virtue of the presence of the electromechanical locking system, in addition to the mechanical retaining systems 170 and 171.

Advantageously, without on-load disconnection, the creation of electric arcs due to such disconnection is prevented, which allows wear on the elements at the points of mechanical contact to be decreased.

Another advantage lies in the fact that unwanted disconnection of a system in operation is made difficult, or even impossible, by the locking of the electrical connector.

Yet another advantage lies in the fact that the force keeping the surfaces in contact with one another is optimized, which substantially decreases the contact resistance exhibited by the electrical connector and increases conductivity.

Lastly, the fact that it is difficult, or even impossible, for a user, to have contact with a live element because of a disconnection increases personal protection and safety.

Figure 3:
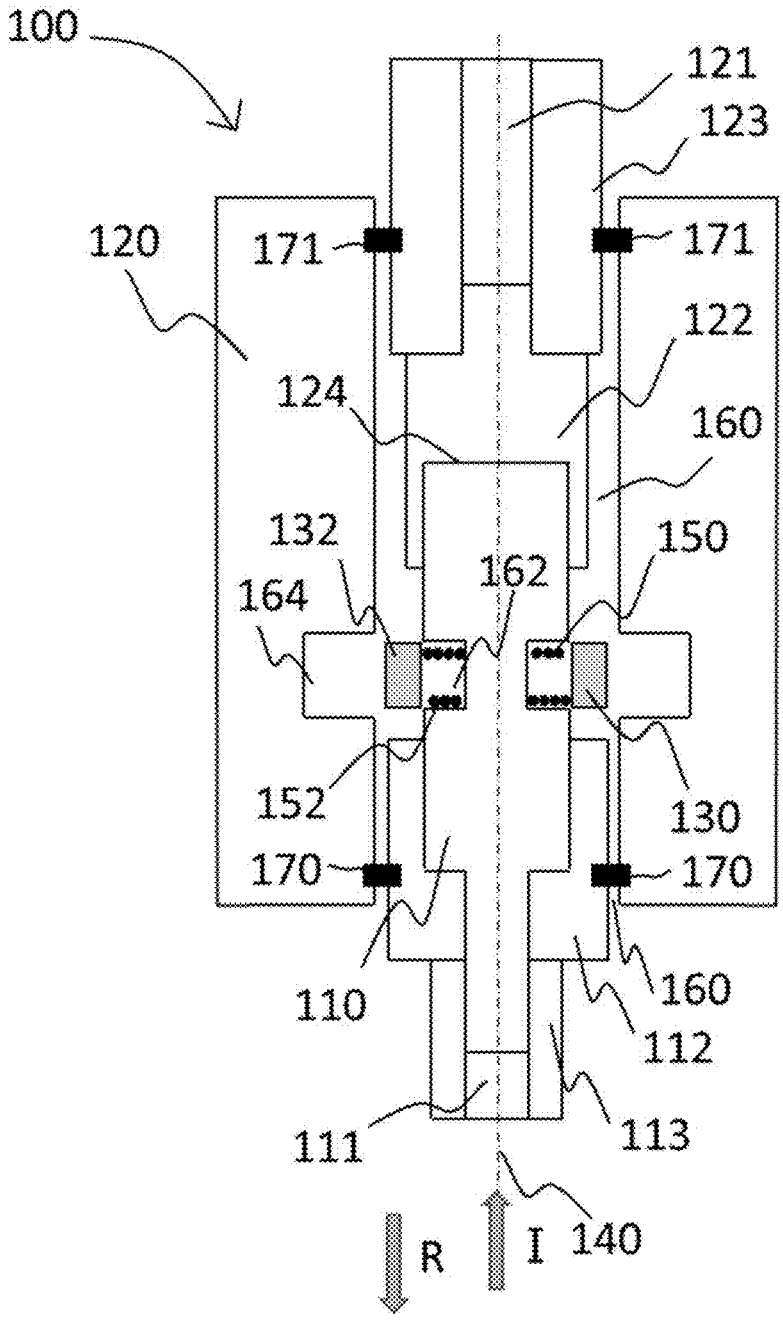
FIG. 3 schematically illustrates an electrical connector according to a second embodiment, in the unlocking configuration.
Figure 4:
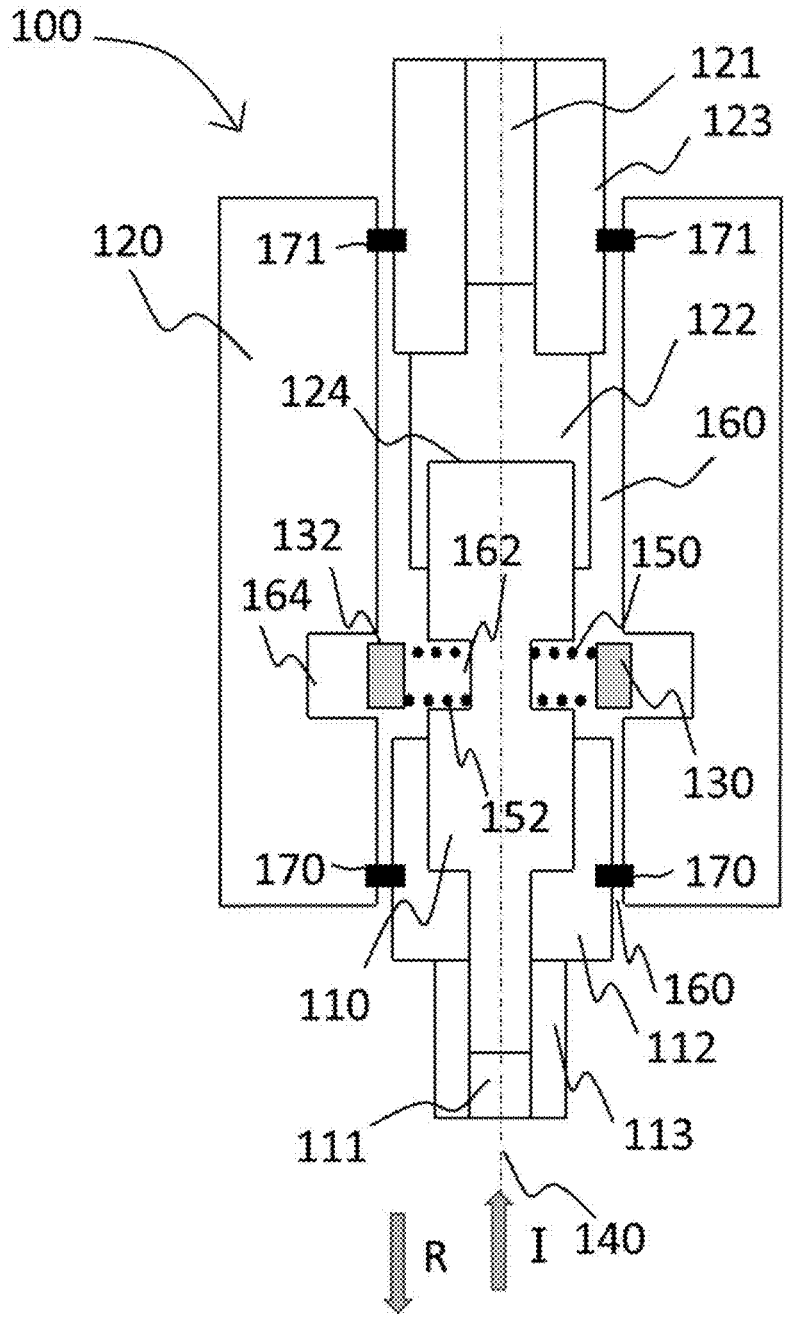
FIG. 4 schematically illustrates the electrical connector already shown in FIG. 3, in the locking configuration.

FIG. 3 is a cross section schematically showing an electrical connector 100 according to a second embodiment. The electrical connector 100, according to this second embodiment, is substantially similar to that described above with the exception that at least one locking system is housed in the first recess 162 such that, in the locking position, the locking element is housed in the second recess 164 formed in the connector body 120 and, in the non-locking position, the locking element 130 is out of the second recess 164. The non-locking position corresponding to this embodiment is shown in FIG. 3 and the locking position is shown in FIG. 4.

Figure 5:
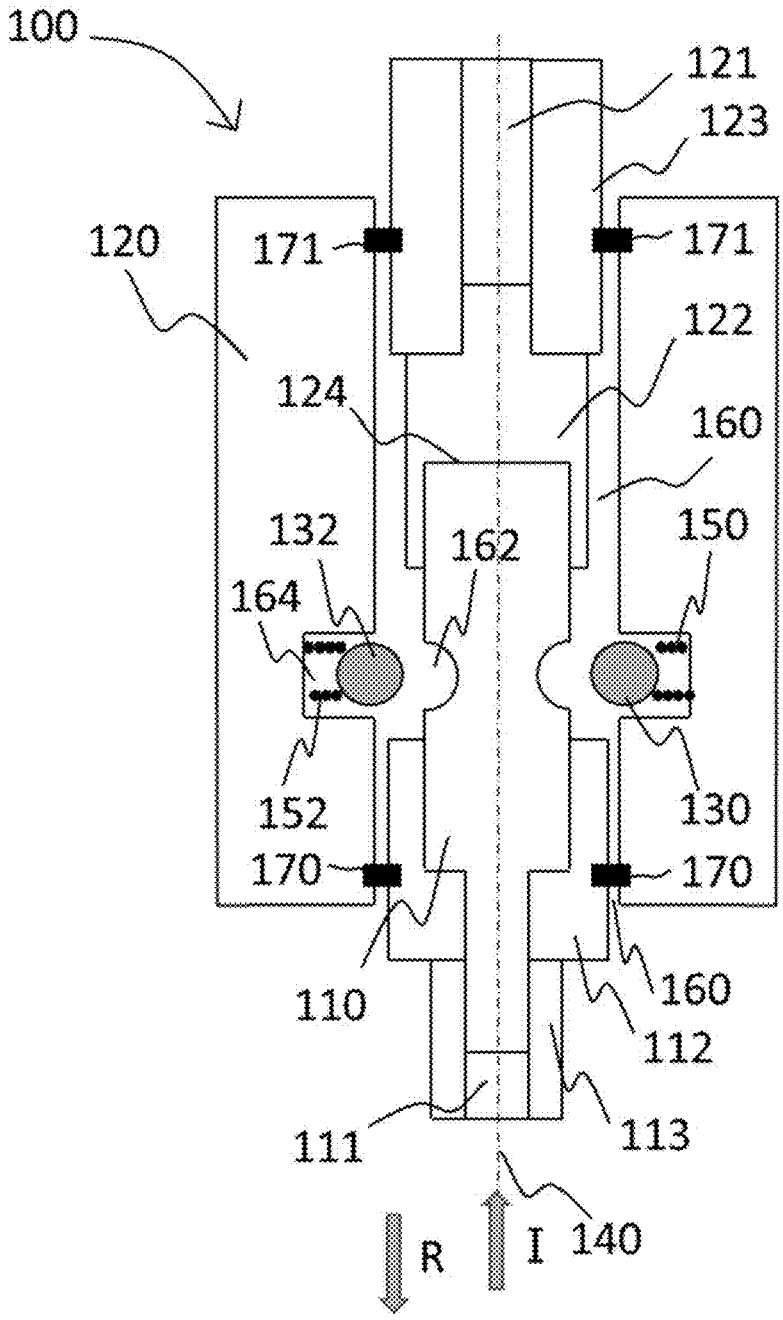
FIG. 5 schematically illustrates an electrical connector according to a third embodiment.

FIG. 5 illustrates an electrical connector 100 according to a third embodiment. According to this third embodiment, the electrical connector 100 is configured according to a principle analogous to those described above with the exception that the connection plug 110 comprises a first recess 162 whose shape is complementary to a spherical shape or to a circular cross section and that the shape of the locking elements 130 and 132 is spherical or has a circular cross section. The shape of the locking elements 130 and 132 is again, here, at least partially complementary to the shape of the first recess 162.

Advantageously, locking using the locking elements 130 and 132 that are arranged with a spherical shape or with a shape of circular cross section, and arranged in the first recess 162 of complementary shape, allows electromechanical locking of the electrical connector 100 while making withdrawal possible when a user exerts a substantial force in the direction of withdrawal represented by the arrow R. Specifically, according to this embodiment, the locking implemented does not feature bearing surfaces perpendicular to the direction of insertion 140 of the electrical connector 100 as seen previously. Thus, when a substantial force is exerted on the connection plug 110 by a user, and in the direction of withdrawal, the locking elements 130 and 132 may be gradually pushed back into the second recess 164 even in the presence of an electromagnetic force induced by an electric current flowing through the electrical connector 100. However, this force has to be large enough to overcome that exerted on the one or more locking elements by the one or more electromagnetic forces induced in the presence of a current in the electrical connector 100.

Figure 6:
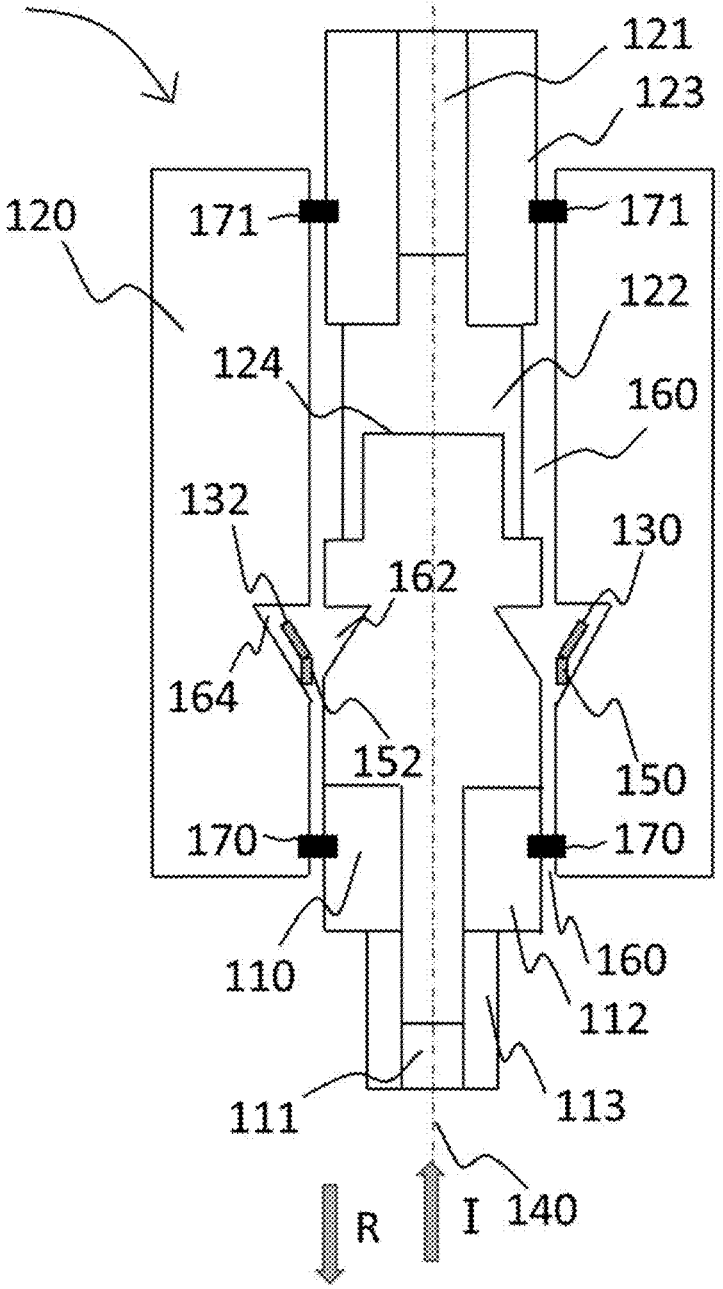
FIG. 6 schematically illustrates an electrical connector according to a fourth embodiment.

FIG. 6 illustrates an electrical connector 100 according to a fourth embodiment. According to this embodiment, the electrical connector 100 is configured according to a principle analogous to those described above with the exception that the connection plug 110 comprises a first recess 162 forming a notch, for example of triangular shape, and that the connector body 120 also comprises here a second recess 164 forming a notch arranged symmetrically with respect to the first recess 162.

According to this embodiment, the locking systems comprise elongate locking elements 130 and 132 such as magnetized strips.

Each return element 150, 152 is at least partially deformable and is, for example, an elastic strip attached by one end to the end of a magnetized strip.

Each magnetized and polarized locking element 130, 132 may be alternatively arranged along the inclined bottom of the first recess 162 or the inclined bottom of the second recess 164.

According to this embodiment, electromechanical locking is achieved by the ends of the locking elements bearing against the surface of the first recess 162 of the connection plug 110 that is substantially perpendicular to the direction of insertion 140 of the electrical connector 100. To that end, and according to the example described, the surface of the first recess 162, perpendicular to the direction of insertion 140, is located on the side of the end of the connection plug 110 which penetrates into the socket 122.

Figure 7:
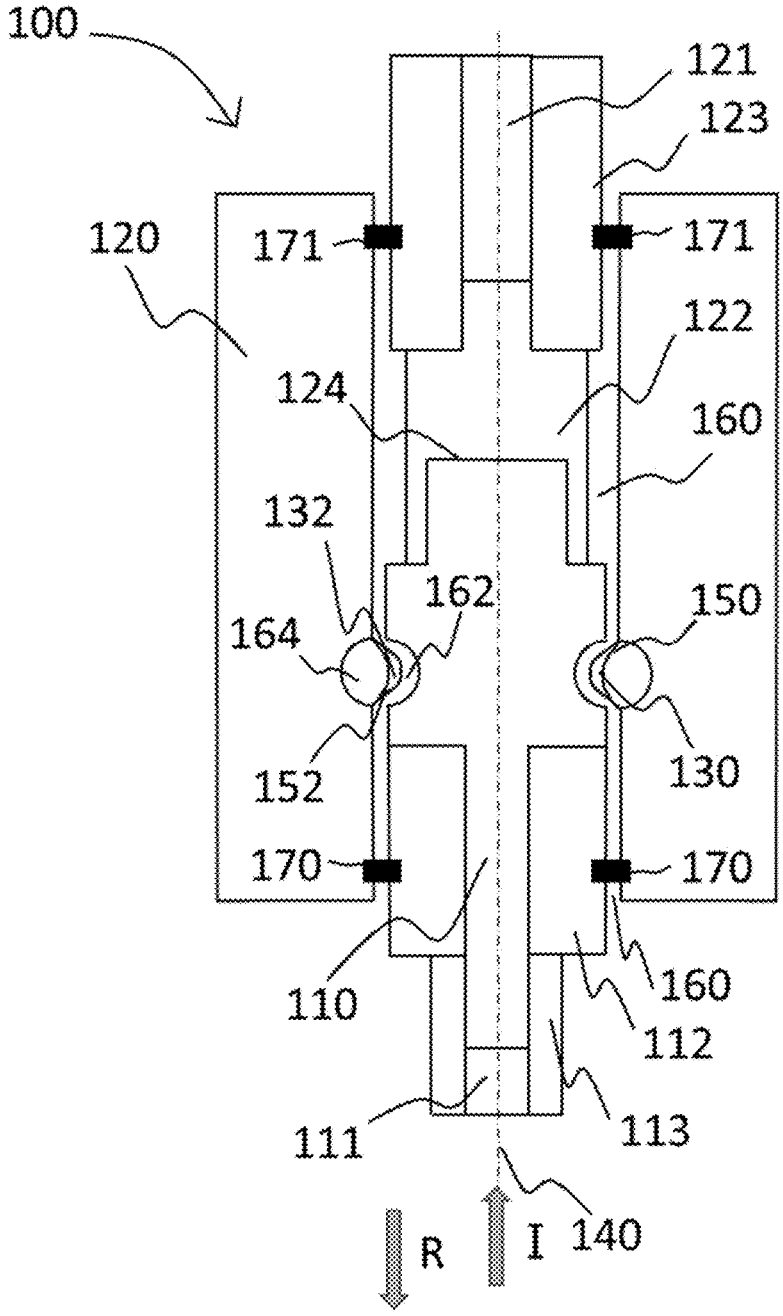
FIG. 7 schematically illustrates an electrical connector according to a fifth embodiment; and, FIG. 8 illustrates an aircraft comprising an electrical connector according to one embodiment.

FIG. 7 illustrates an electrical connector 100 according to a fifth embodiment. According to this embodiment, the electrical connector 100 is configured according to a principle analogous to those already described above with the exception that the locking systems are in one piece and each have an arcuate cross section. The locking systems according to this embodiment comprise a central portion and a flexible peripheral portion. The central portion is magnetized, polarized and forms the locking element. The flexible peripheral portion is fixed around the central portion and it keeps it secured to the connector body 120. The flexible peripheral portion is preferably elastic, effecting a return action, such that the central portion may be moved alternately towards the inside of the first recess 162 or of the second recess 164. According to this embodiment, the electromechanical locking may be unlocked by exerting a substantial force in the direction of withdrawal represented by the arrow R, since the locking elements have shapes that are able to be modified by a relative movement of the first recess 162 with respect to the second recess 164, under the effect of a pull exerted by a user.

Thus, a locking system for the connector may, for example, comprise a plurality of magnetized locking elements whose shapes are at least partially complementary to a shape of a connection plug and be substantially arranged concentrically with a connection plug or with a cross section of a connection plug. For example, a locking system may take the shape of a crown bearing a plurality of ferromagnetic and polarized studs, which are joined to the inside or to the outside of the crown via return elements.

Additionally, and according to some variant embodiments, the recesses 162 and 164 are not circular, i.e., they do not extend, respectively, all the way around the periphery of the connection plug 110 and of the connector body 120 and form single cavities, the shape of each of which is complementary to the shape of a locking element configured to operate with it.

Systems implementing one or more avionics functions, or more broadly the technical elements that are conventionally present on board aircraft, often require interconnection between them using numerous connection harnesses or wired connections. Thus, an electrical connector such as described above is particularly advantageous when it is integrated into such a system. The invention pertains to an avionics system comprising one or more electrical connectors such as described above and to an aircraft comprising such an avionics system.

Figure 8:
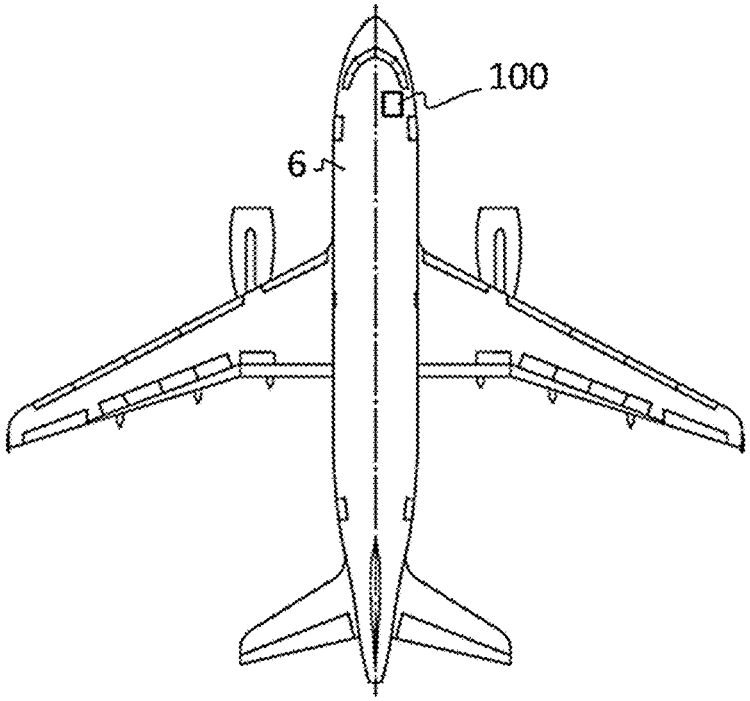

FIG. 8 shows an aircraft 6 comprising an avionics system which comprises an electrical connector 100.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

The invention claimed is:

1. An electrical connector comprising:

a socket made in an electrically conductive material, a connector body made in an electrically insulating material and in which the socket is fixed, where the connector body has a cavity allowing access to the socket, a connection plug made in an electrically conductive material and configured to be inserted into the cavity in a direction of insertion and to come into contact with the socket, and, the electrical connector comprising:

a locking system comprising a locking element and a return element, the locking element comprising a polarized ferromagnetic material and being movably mounted on one from among the connector body and the connection plug to be movable between a locking position in which the locking element is housed in a recess formed in a surface of the other from among the connection plug and the connector body, and a non-locking position in which said locking element is out of said recess, and where the return element holds the locking element in the non-locking position.

2. The electrical connector according to claim 1, wherein the locking element is a stud having a shape that is at least partially complementary to a shape of said recess, attached to the return element, wherein the return element is a spring attached substantially perpendicularly to the direction of insertion to one from among the connector body and the connection plug, and wherein the stud is mounted so as to be movable in a direction transverse to the direction of insertion.

3. The electrical connector according to claim 1, wherein the locking system is mounted on the connector body.

4. The electrical connector according to claim 1, wherein the locking system is mounted on the connection plug.

5. The electrical connector according to claim 1, wherein the shape of the locking element is spherical or has a circular cross section, and wherein the shape of the recess is complementary to a spherical shape or to a circular cross section.

6. The electrical connector according to claim 1, wherein the locking element is a magnetized strip, and wherein the return element is an elastic strip, the magnetized strip and the elastic strip being attached to one another by one of their respective ends.

7. The electrical connector according to claim 1, wherein the locking element is a magnetized and polarized central portion, and wherein the return element is a flexible, preferably elastic, peripheral portion, attached around the central portion.

8. The electrical connector according to claim 1, further comprising a plurality of locking systems distributed around the direction of insertion.

9. An electrical or electronic system configured to implement one or more avionics functions comprising at least one electrical connector according to claim 1.

10. An aircraft comprising at least one electrical or electronic system according to claim 9.

* * * * *